US008297806B2

(12) United States Patent
Leary et al.

(10) Patent No.: US 8,297,806 B2
(45) Date of Patent: Oct. 30, 2012

(54) SEARCHLIGHT HAVING PULL-IN BEZEL RETENTION FOR MARINE APPLICATIONS

(75) Inventors: Kevin Joseph Leary, Hamilton, MA (US); Samuel Hinckley, Nashua, NH (US); Robert King, South Hamilton, MA (US); Kenneth J. LeBlanc, Gloucester, MA (US)

(73) Assignee: Xylem IP Holdings LLC, White Plains, NY (US)

( * ) Notice: Subject to any disclaimer, the term of this patent is extended or adjusted under 35 U.S.C. 154(b) by 410 days.

(21) Appl. No.: 12/554,213

(22) Filed: Sep. 4, 2009

(65) Prior Publication Data

US 2010/0135033 A1 Jun. 3, 2010

Related U.S. Application Data

(60) Provisional application No. 61/096,107, filed on Sep. 11, 2008.

(51) Int. Cl.
*F21V 19/00* (2006.01)

(52) U.S. Cl. ..... 362/382; 362/523; 362/257; 362/427; 362/418

(58) Field of Classification Search ..... 362/382, 362/427, 428, 430, 285, 418, 287, 362, 364, 362/365, 368, 504, 476, 283, 257
See application file for complete search history.

(56) References Cited

U.S. PATENT DOCUMENTS

| | | | | |
|---|---|---|---|---|
| 2,115,982 | A | | 5/1938 | Worden |
| 3,634,677 | A | | 1/1972 | Wolffing-Seelig et al. |
| 3,979,649 | A | | 9/1976 | Persha |
| 3,987,296 | A | | 10/1976 | Coppola et al. |
| 4,259,710 | A | * | 3/1981 | Schlack ..... 362/267 |
| 4,353,110 | A | * | 10/1982 | Ellis ..... 362/35 |
| 4,386,391 | A | | 5/1983 | Gulliksen et al. |
| 4,578,575 | A | | 3/1986 | Roos |
| 4,709,305 | A | * | 11/1987 | McMahan et al. ..... 362/519 |
| 5,030,886 | A | | 7/1991 | Darrow |
| 5,228,770 | A | | 7/1993 | Brunson |
| 5,490,046 | A | | 2/1996 | Gohl et al. |

(Continued)

FOREIGN PATENT DOCUMENTS

EP 1124090 8/2001

(Continued)

OTHER PUBLICATIONS 4 pages PCT/US09/56003 International Search Report mailed Nov. 3, 2009.

(Continued)

*Primary Examiner* — Danielle Allen

(57) ABSTRACT

A searchlight is provided featuring a bezel pull-in retention assembly having a frame and a housing. The frame has a back plate configured with at least one opening to receive a fastening device. The housing is configured with a front end opening for receiving the frame, configured with a back end opening having an outer rim for receiving a seal plate, the seal plate configured to be adapted in the rim of the back end opening, to receive the fastening device and to fixedly couple the frame to the housing.

12 Claims, 10 Drawing Sheets

U.S. PATENT DOCUMENTS

| | | | | |
|---|---|---|---|---|
| 5,589,901 | A | 12/1996 | Means | |
| 5,695,272 | A | 12/1997 | Snyder et al. | |
| 5,806,956 | A * | 9/1998 | Hyun-Jo | 362/35 |
| 6,609,812 | B2 | 8/2003 | Machi et al. | |
| 6,786,622 | B1 * | 9/2004 | Rice | 362/362 |
| 6,896,392 | B2 * | 5/2005 | Jigamian et al. | 362/202 |
| 7,011,439 | B1 | 3/2006 | Kane et al. | |
| 7,044,623 | B2 | 5/2006 | Olsson et al. | |
| 7,824,075 | B2 * | 11/2010 | Maxik | 362/294 |
| 2006/0087839 | A1 | 4/2006 | Yuen | |
| 2006/0158887 | A1 | 7/2006 | Holder et al. | |
| 2008/0043098 | A1 * | 2/2008 | Leblanc | 348/113 |

FOREIGN PATENT DOCUMENTS

| | | |
|---|---|---|
| EP | 1650078 | 4/2006 |
| EP | 1683720 | 7/2006 |

OTHER PUBLICATIONS 4 pages PCT/US09/55993 International Search Report mailed Nov. 10, 2009.

* cited by examiner

SEARCHLIGHT HAVING PULL-IN BEZEL RETENTION FOR MARINE APPLICATIONS

CROSS-REFERENCE TO RELATED APPLICATIONS

This application claims benefit to provisional patent application Ser. No. 61/096,107, filed 11 Sep. 2008, which is hereby incorporated by reference in its entirety.

This application is also related to patent application Ser. No. 12/554,190, entitled "Searchlight Having Rotational Beam Focus for Marine Applications, filed concurrently herewith, which is also hereby incorporated by reference in its entirety.

BACKGROUND OF THE INVENTION

1. Field of the Invention

This invention relates to a searchlight; and more particularly, relates to a searchlight having a ring or bezel arranged around a bulb or lens for the purpose of retaining those components and achieving a desired cosmetic appearance.

2. Description of Related Art

Searchlights are known in the art.

For example, U.S. Pat. No. 4,709,305 discloses an electrical connector for use with a headlight assembly, which comprises a headlight sandwiched between a bezel and a housing with an inner surface of the housing overlying the back surface of the headlight with an access hole in the housing opening to the headlight terminals.

Moreover, U.S. Pat. No. 7,044,623 discloses a thru-hull light for water vessels, which includes O-rings which provide watertight seal between sapphire window and forward end of lamp housing to prevent water from entering interior of lamp housing.

In spite of this, most marine lighting products utilize a ring or bezel around the bulb or lens for the purpose of retaining those components and achieving the desired cosmetic appearance. A variety of techniques are known for retaining this fascia piece, including bolting from the front, and/or splitting the light housing around its equator. These solutions do not allow a smooth, continuous housing that is free from visible fasteners. In addition, former implementations have resulted in unreliable sealing and bezel retention due to the use of undersized, widely-spaced front fasteners.

There is a need in the industry for a new technique for arranging a ring or bezel around a bulb or lens for the purpose of retaining those components and achieving a desired cosmetic appearance.

SUMMARY OF THE INVENTION

The present invention provides a new and unique searchlight featuring a bezel pull-in retention assembly having a frame and a housing. The frame has a back plate configured with at least one opening to receive a fastening device. The housing is configured with a front end opening for receiving the frame, configured with a back end opening having an outer rim for receiving a seal plate, the seal plate configured to be adapted in the rim of the back end opening, to receive the fastening device and to fixedly couple the frame to the housing.

According to some embodiments of the present invention, the fastening device may take the form of one or more combinations of a bolt and a nut, e.g. where the bolt is passed through an opening in the frame, through an opening in the seal plate, and the nut is tightened on the bolt to pull the frame into the housing.

According to some embodiments of the present invention, the seal plate may be configured with threads to receive corresponding threads of the fastening device, and the bolt is passed through an opening in the frame, and threaded onto the threads of the seal plate.

According to some embodiments of the present invention, the frame may include a base plate or portion configured to receive one or more searchlight components, including an assembly configured to rotate the housing, or another assembly configured to mount the housing to another device.

According to some embodiments of the present invention, the frame is configured to retain a bezel that forms part of a light source.

The present invention may also take the form of a method featuring configuring a frame in relation to a front end opening of a housing, and a seal plate in relation to an outer rim of a back end opening of the housing; and coupling the frame and the seal plate together by passing a fastening device through an opening in a back plate of the frame so as to pull the frame into, and affix the frame to, the housing.

According to some embodiments of the present invention, the coupling may further comprise passing a bolt through the opening of the back plate and also through an opening in the seal plate, and tightening a nut onto the bolt to pull the frame into, and affix the frame to, the housing.

According to some embodiments of the present invention, the coupling may comprise passing a bolt through the opening of the back plate and tightening threads of the bolt into corresponding threads of the seal plate to pull the frame into, and affix the frame to, the housing.

According to some embodiments of the present invention, the method may also include configuring one or more searchlight components on a base plate or portion of the frame, including an assembly configured to rotate the housing, or another assembly configured to mount the housing to another device.

According to some embodiments of the present invention, the method may also include configuring a bezel that forms part of a light source onto a portion of the frame is configured to retain the bezel.

The aforementioned prior art does not discloses a technique for pull-in bezel retention, especially by pulling a bezel frame into a searchlight housing using nuts and bolts, where the frame holds the internal motor chassis of the overall search lamp assembly.

These and other features, aspects, and advantages of embodiments of the invention will become apparent with reference to the following description in conjunction with the accompanying drawings. It is to be understood, however, that the drawings are designed solely for the purposes of illustration and not as a definition of the limits of the invention.

BRIEF DESCRIPTION OF THE DRAWING

The drawing, which is not necessarily to scale, include the following Figures.

In the following description of the exemplary embodiment, reference is made to the accompanying drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIGS. 1 to 4*b* show various features and aspects of a new and unique searchlight according to some embodiments of the present invention. The description of this searchlight below is provided by way of example, is not intended to be limiting, and is intended to include modifications within the spirit of the underlying invention using alternative features, elements, or other suitable technology that is either now known or later developed in the future.

Figure 1:
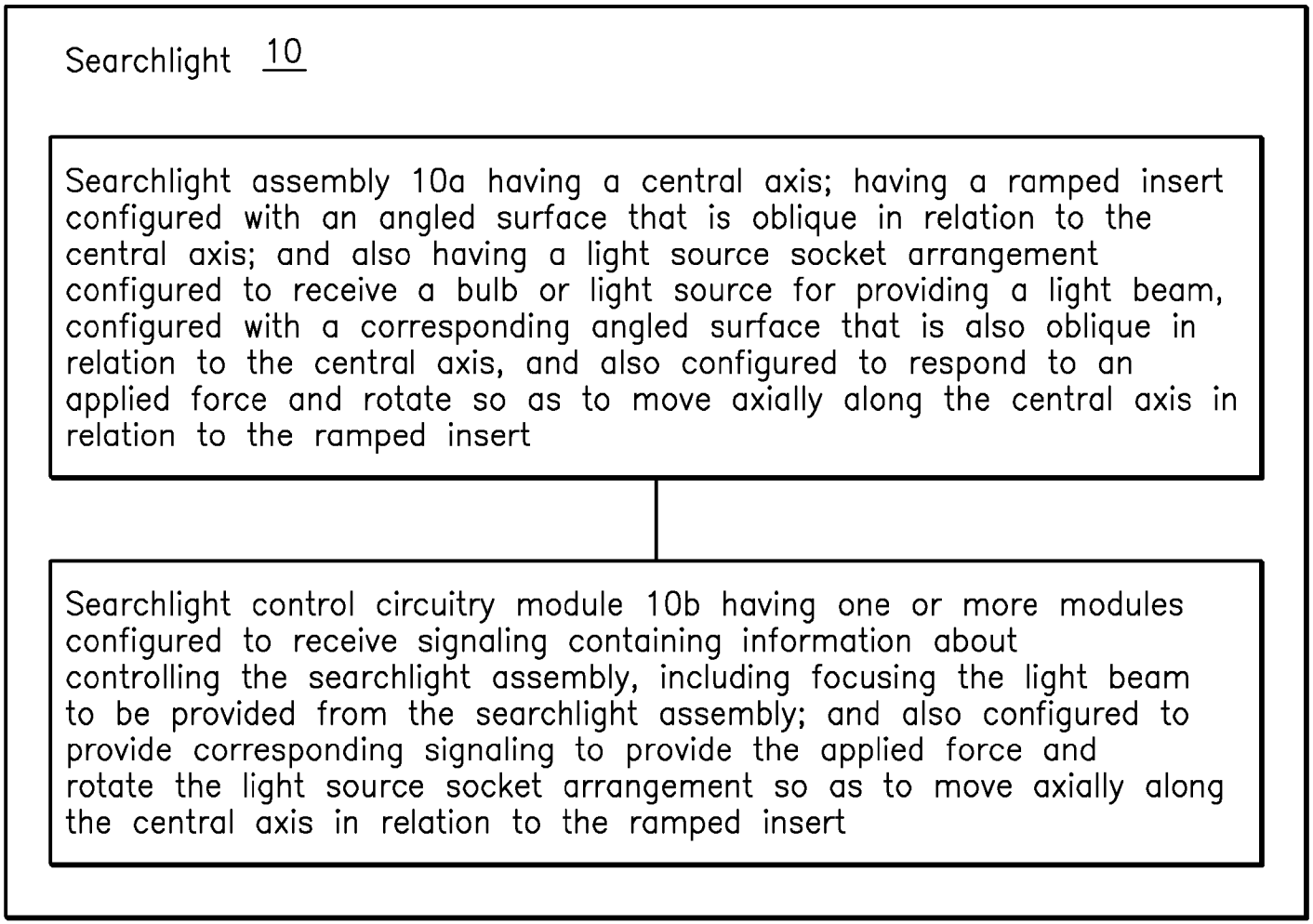
FIG. 1 shows a clock diagram of a searchlight according to some embodiments of the present invention.
Figure 1A:
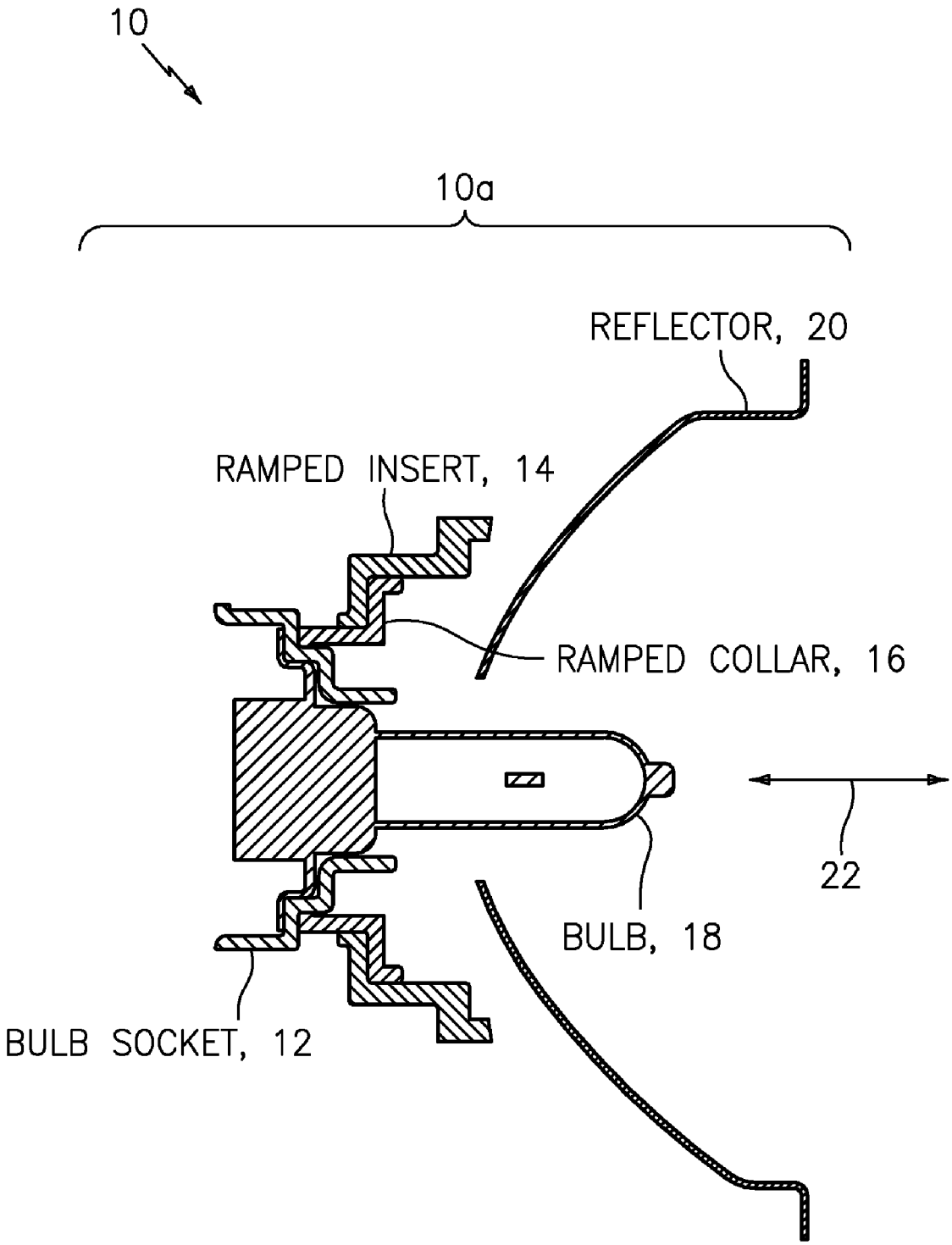
FIG. 1*a* shows a diagram of a bulb socket, a ramped insert, a ramped collar, a bulb and a reflector that form part of a searchlight assembly of the searchlight shown in FIG. 1 according to some embodiments of the present invention.
Figure 1B:
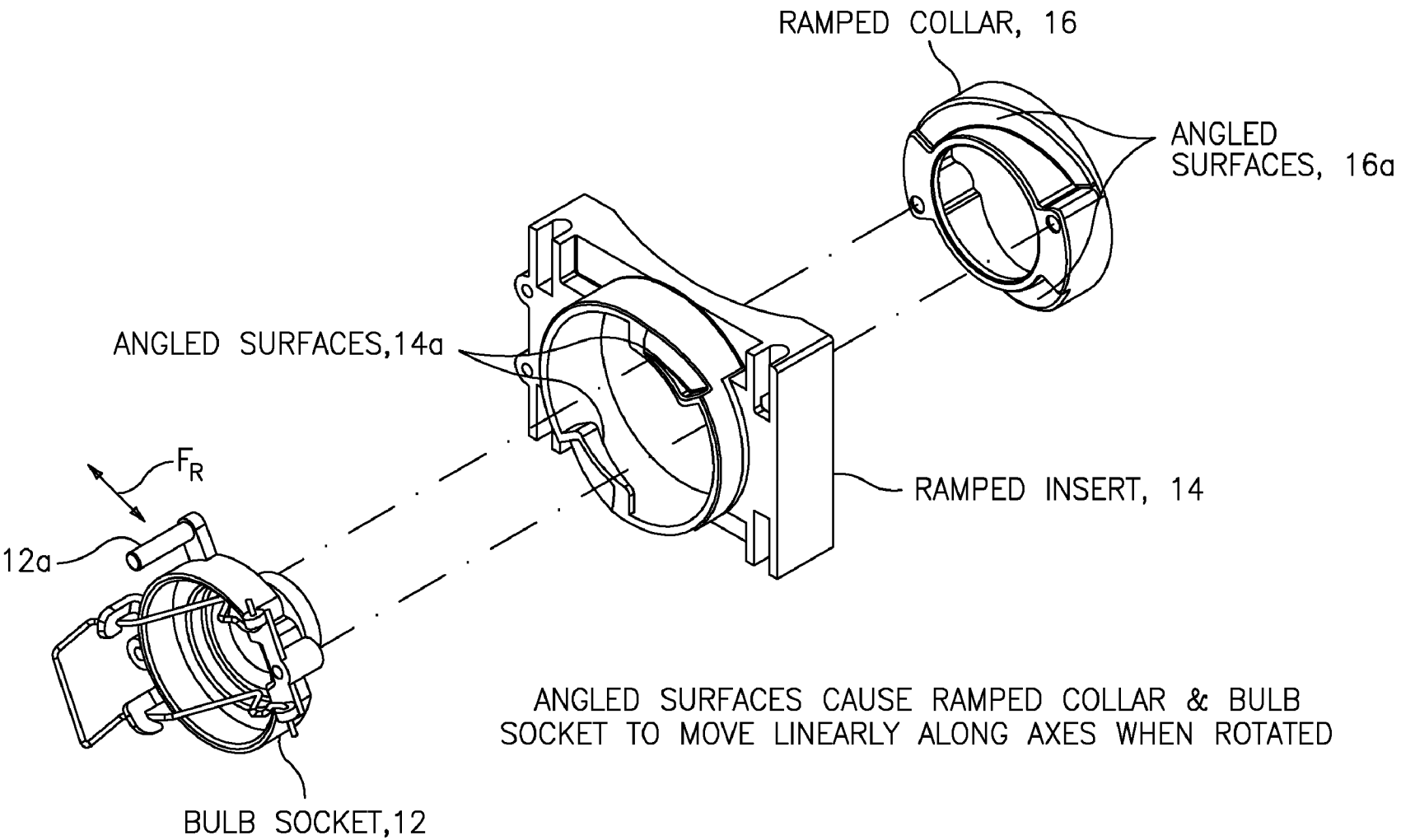
FIG. 1*b* shows an exploded view of a bulb socket, a ramped insert and a ramped collar that form part of a searchlight assembly of the searchlight shown in FIG. 1 according to some embodiments of the present invention.
Figure 1C:
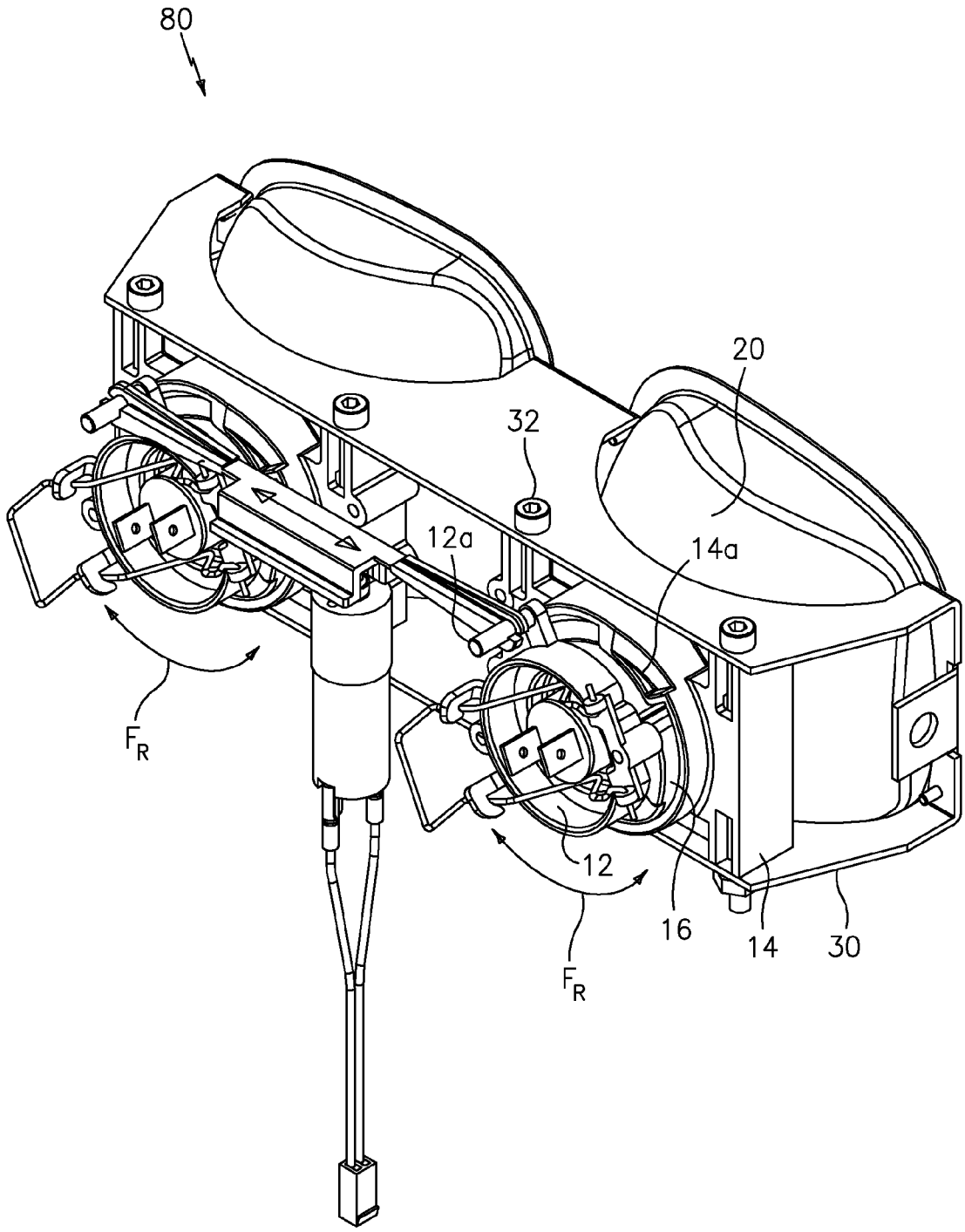
FIG. 1*c* shows a view of a dual beam configuration of a searchlight assembly of the searchlight shown in FIG. 1 according to some embodiments of the present invention.
Figure 1D:
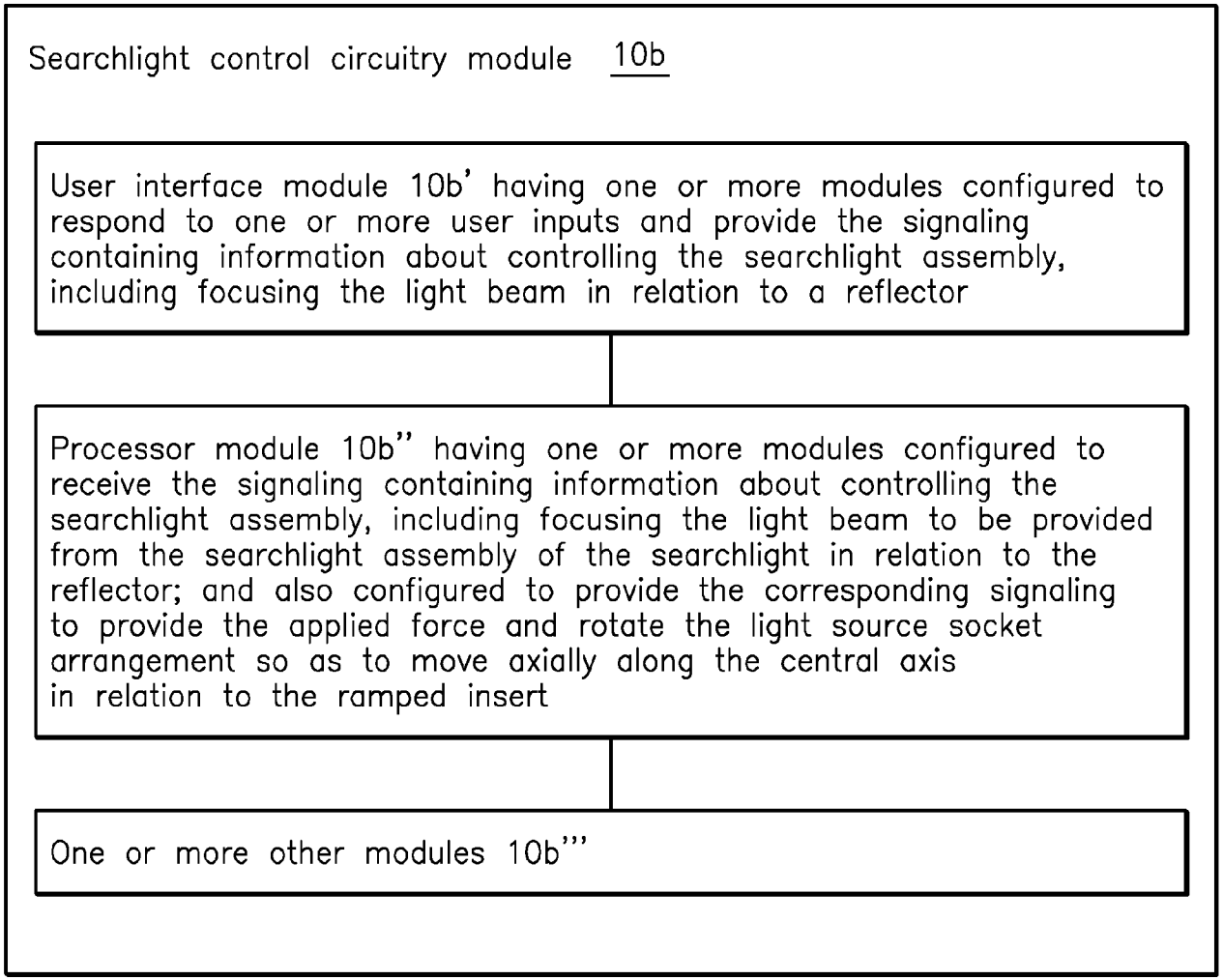
FIG. 1*d* show a block diagram of a searchlight control circuitry that forms part of the searchlight shown in FIG. 1 according to some embodiments of the present invention.
Figure 2A:
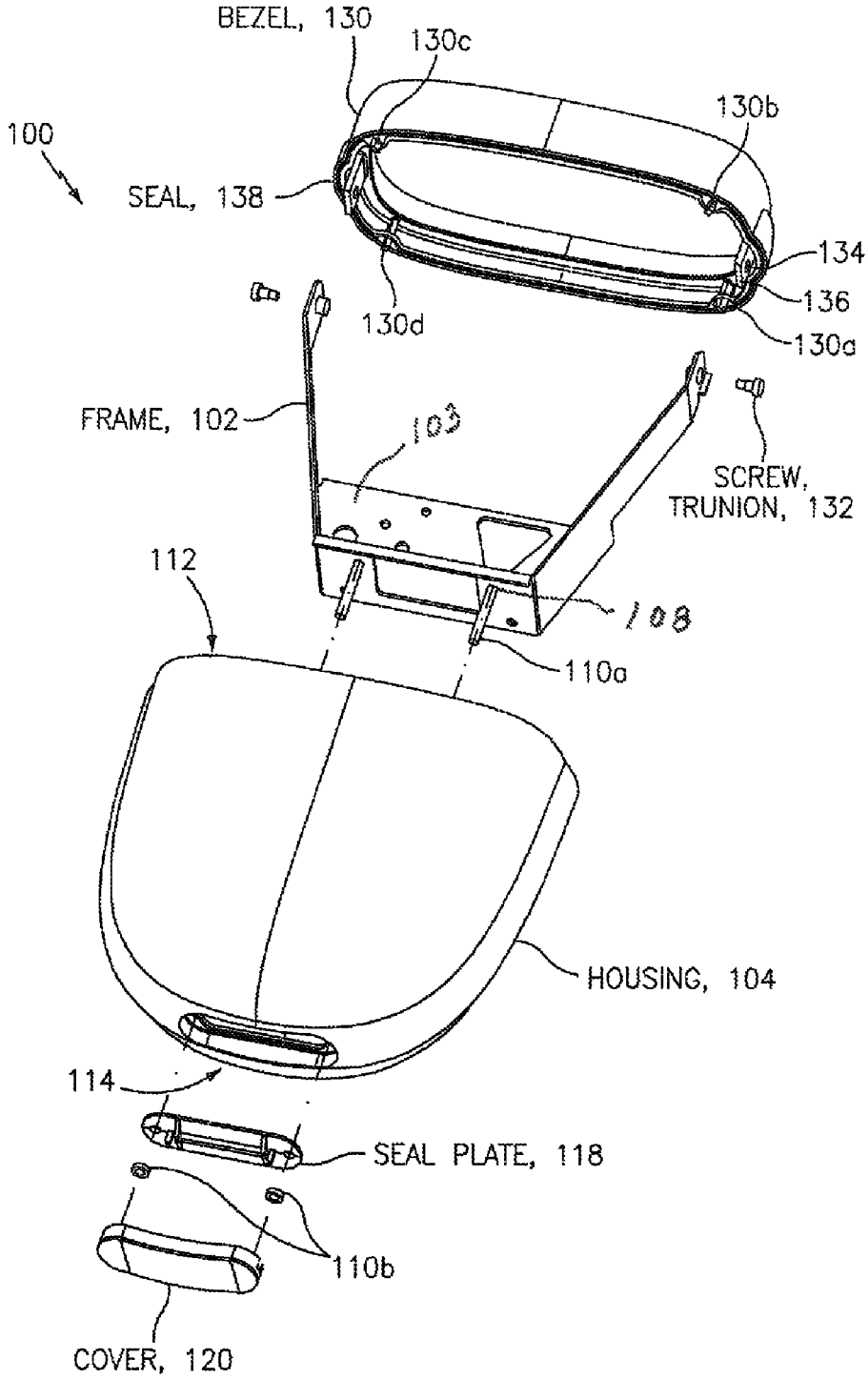
FIG. 2*a* shows another exploded view of a frame, a housing, a seal plate, a cover, nuts and bolts and a bezel that form part of a searchlight assembly of a searchlight according to some embodiments of the present invention.
Figure 2B:
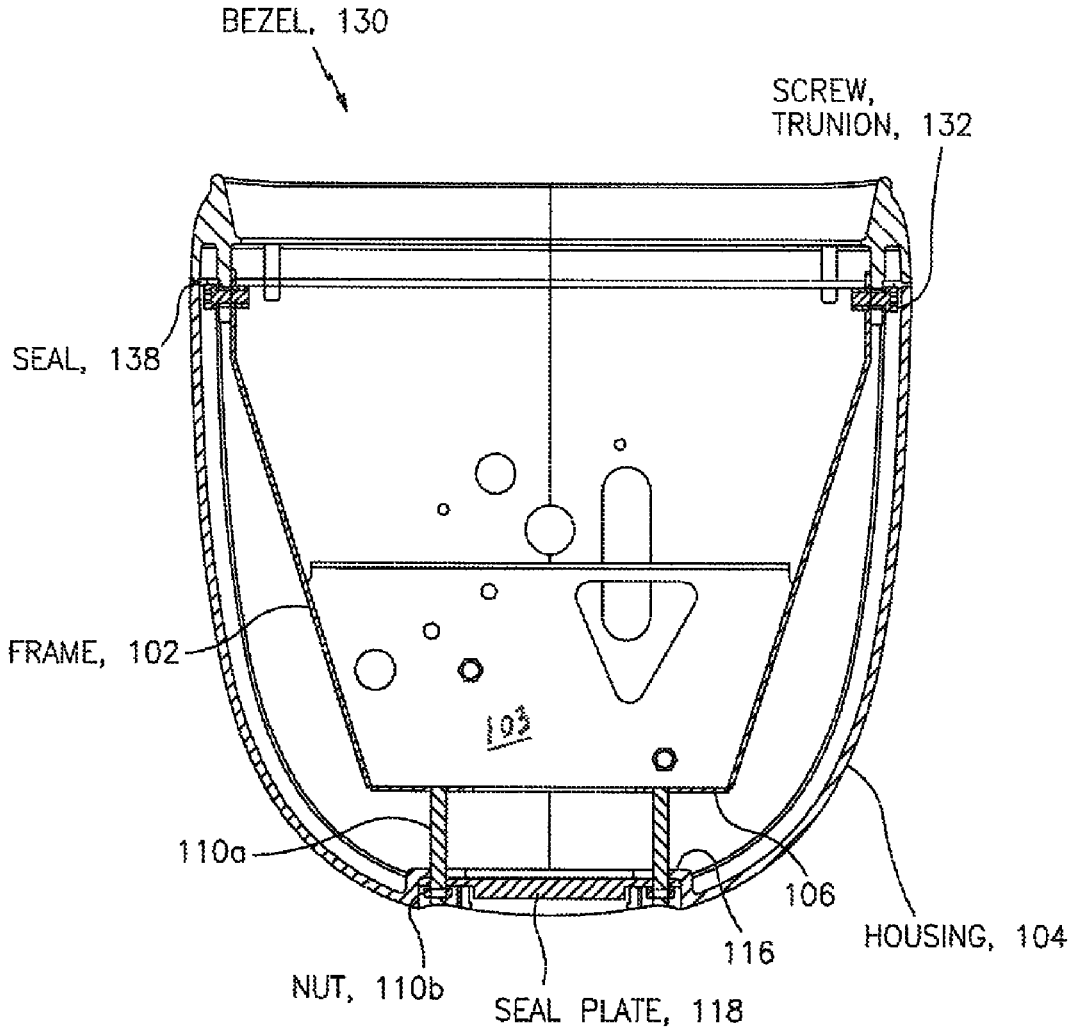
FIG. 2*b* shows a cross-sectional view of a frame, a housing, a seal plate, a cover, nuts and bolts and a bezel, when assembled together, that form part of a searchlight assembly of a searchlight according to some embodiments of the present invention.

By way of example, FIGS. 2*a*, 2*b* show basic features of a bezel pull-in retention apparatus or technique according to some embodiments of the present invention, while the remaining FIGS. 1, 1*a*, 1*b*, 1*c*, 1*d* and 3*a*-4*b* show other features and aspects of other inventions that form part of other related applications.

FIGS. 1*a*-1*d*

The Rotational Beam Focus

In FIG. 1, the searchlight 10 features a searchlight assembly 10*a* in combination with a searchlight control circuitry module 10*b* for implementing a rotational beam focus according to some embodiments of the present invention.

FIGS. 1*a*-1*d*

The Searchlight Assembly 10*a*

In particular, FIGS. 1*a* and 1*b* show a bulb socket 12, a ramped insert 14, a ramped collar 16, a bulb or light source 18 and a reflector 20 that form part of the searchlight assembly 10*a* of the searchlight 10 according to some embodiments of the present invention. As shown, the searchlight assembly 10*a* has a central axis generally indicated by arrow 22.

The searchlight assembly 10*a* also includes a light source socket arrangement 12, 16 that is formed by the combination of the light socket 12 and the ramped collar 16.

The ramped insert 14 is configured with one or more angled surfaces 14*a* that are obliquely curved in relation to the central axis 22.

The light source socket arrangement 12, 16 is configured to receive the bulb or light source 18, and is also configured with one or more corresponding angled surfaces 16*a* that are also obliquely curved in relation with to the central axis 22.

In operation, the light source socket arrangement 12, 16 is configured to respond to an applied force, e.g., a rotational force $F_R$ (see FIG. 1*b*), applied in relation to the central axis 22 and rotate so as to move axially along the central axis 22 in relation to the ramped insert 14. As shown, the rotational force $F_R$ (FIG. 1*b*) is applied substantially traverse to the central axis 22, and the axial movement of the light source socket arrangement 12, 16 is substantially parallel to the central axis 22. The rotational force $F_R$ may be applied to a pivot rod 12*a* extending from the bulb or light source socket 12 (See also FIG. 1*c*), although the scope of the invention is intended to include other configurations for applying the force and rotating the light source socket arrangement 12, 16 in relation to the ramped insert 14 in order to move axially along the central axis 22 the light source socket arrangement 12, 16 in relation to the ramped insert 14 that are either now known or later developed in the future.

In response to the rotational force $F_R$, the corresponding angled surface 16*a* of the ramped collar 16 of the light source socket arrangement 12, 16 slides on, or in relation to, the angled surface 14*a* of the ramped insert 14, causing the light source socket arrangement 12, 16 to rotate and move axially along the central axis 22 in relation to the ramped insert 14.

The light source socket arrangement 12, 16 may be configured so that the bulb or light source socket 12 is fixedly coupled to the ramped collar 16, by, for example, rods/bolts and nuts (not shown), according to some embodiments of the present invention. The scope of the invention is not intended to be limited to the type, kind or ways of coupling the bulb or light source socket 12 and the ramped collar 16, including types, kinds or ways either now known or later developed in the future.

The searchlight assembly 10*a* may also include a housing or chassis 30 (FIG. 1*c*), and the ramped insert 16 may be fixedly coupled to the housing or chassis 30 with bolts 32, according to some embodiments of the present invention.

The bulb or light source socket 12 may be configured to receive the rotational force $F_R$ as a transverse rotational force applied in relation to the central axis, so as to rotate and move in an axial translation along the central axis 22, according to some embodiments of the present invention.

The searchlight assembly may also comprise a reflector 20 that is configured and arranged in relation to the central axis 22 for focusing the light beam, according to some embodiments of the present invention. For example, the movement of the bulb or light source 18 and the light socket arrangement 12, 16 axially along the central axis 22 in relation to the ramped insert 14 causes the bulb or light source 18 to move in relation to the reflector 20 that enables the degree of focus of a light beam emanating from the bulb or light source 18 to change by moving the bulb or light source 18 in and out along the central axis 22 of the reflector 20, including so as to provide progressive spot-to-flood focusing, and vice versa, according to some embodiments of the present invention.

FIG. 1*c*

The Dual-Beam Configuration

FIG. 1*c* shows a searchlight generally indicated as 90 having two searchlight assembly that together form of a dual beam configuration, where each searchlight assembly includes a respective central axis, a respective ramped insert and a respective light source socket arrangement, consistent with that described above. In FIG. 1*c*, similar elements are labeled with similar reference numerals as shown in FIG. 1*a*, 1*b*. The dual beam configuration in FIG. 1*c* may also comprise a central actuator and linkage 40 configured to focus two parallel beams simultaneously to position and synchronize respective ramped collars, according to some embodiments of the present invention. FIG. 1*c* includes other features or devices that do not form part of the underlying invention. Moreover, the functionality of such other features or devices is, or would be, known in the art, and are not described in detail herein.

In effect, FIGS. 1*a*, 1*b* and 1*c* show a rotational beam focus feature according to some embodiments of the present invention, that enables the degree of focus of the light beam to be changed by moving the bulb or light source 18 in and out, along the central axis 22 of, or in relation to, the reflector 20 (See FIG. 1*a*). By way of example, one technique of controlling this motion is to mount the bulb or light source on, or in relation to, the light socket arrangement 12, 16, which includes bulb or light socket 12 and the ramped collar 16; allowing the user to rotate the bulb socket arrangement or chassis 12, 16 to change the axial position of the bulb or light source 18 relative to the reflector 20.

FIG. 1*d*

Searchlight Control Circuitry Module

FIG. 1*d* shows a new and unique searchlight control circuitry 10*b* featuring a user interface module 10*b*', a processor module 10*b*", and one or more other modules 10*b*'", according to some embodiments of the present invention.

The user interface module 10*b*' includes one or more modules configured to respond to one or more user inputs and provide the signaling containing information about focusing the light beam.

The processor module 10*b*" includes one or more modules configured to receive the signaling containing information about controlling the searchlight assembly, including focusing the light beam to be provided from the searchlight assembly 10*a* of the searchlight 10, where the searchlight assembly includes features consistent with that set forth above; and also configured to provide the corresponding signaling to provide the applied force and rotate the light source socket arrangement 12, 16 (FIGS. 1*a*, 1*b*) so as to move axially along the central axis 22 (FIGS. 1*a*, 1*b*) in relation to the ramped insert 14 (FIGS. 1*a*, 1*b*), e.g. including for focusing the light beam to be provided from the searchlight assembly 10*a* of the searchlight 10 in relation to the reflector 20.

The one or more modules may be configured to receive the signaling from a control module of a searchlight controller, according to some embodiments of the present invention. The one or more modules may also be configured to provide the corresponding signaling to the control module of the searchlight assembly, and/or the corresponding signaling comprises a signal for controlling a motor that forms part of the searchlight assembly, according to some embodiments of the present invention.

By way of example, and consistent with that described herein, the functionality of the one or more modules of the user interface module 10*b*' and the processor module 10*b*" may be implemented using hardware, software, firmware, or a combination thereof, although the scope of the invention is not intended to be limited to any particular embodiment thereof. In a typical software implementation, the one or more module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology now known or later developed in the future. Moreover, the scope of the invention is intended to include the one or more modules being a stand alone modules, as shown, or in the combination with other circuitry for implementing another module.

The one or more other modules 10*b*'" may perform other functionality related to the searchlight that does not form part of the underlying invention and is thus not described in detail herein.

FIGS. 2*a*, 2*b*

Pull-In Bezel Retention

FIGS. 2*a*, 2*b* show a pull-in bezel retention system 100 that may form part of the searchlight 10 (FIG. 1) according to some embodiments of the present invention.

The pull-in bezel retention system 100 features a frame 102 and a housing 104. The frame has a back plate 106 configured with at least one opening 108 to receive a fastening device 110*a*, 110*b*. The housing 104 is configured with a front end opening generally indicated as 112 for receiving the frame 102, configured with a back end opening 114 having an outer rim 116 for receiving a seal plate 118, the seal plate 118 configured to be adapted in the outer rim 116 of the back end opening 114, to receive the fastening device 110*a*, 110*b* and to fixedly couple the frame 102 to the housing 104. The pull-in bezel retention system 100 includes a cover 120 configured to be arranged in the back end opening 114. FIG. 2*b* shows the pull-in bezel retention system 100 as assembled.

In effect, the pull-in bezel retention system 100 retains a bezel 130 and lens without the use of visible fasteners, i.e. that is fasteners that can be seen from the outside once the system 100 is assembled. The bezel 130 is connected solidly to the frame 102 that forms a rigid, internal motor chassis by passing screws 132 through openings 134 in bezel tabs 136, and that is pulled into the housing 104 via the threaded studs 110*a* and nuts 110*b* located in a pocket or well at the Aft end of the housing 104 (See FIG. 2*a*). By tightening the retainer nuts 110*b*, the frame or chassis 102 is pulled aft, compressing the Bezel 130 against a water-tight seal 138 at the forward interface with the main housing. The bezel 130 and housing 104 contain aligning features generally indicated as 130*a*, 130*b*, 130*c*, 130*d* for relative location, but no fasteners. Typically marine searchlights include a badge at the aft end, so the cover or coverplate can easily be used to hide the bezel retaining nuts or fasteners 110*b* (See FIG. 2*b*).

The frame 102 may include a base plate or portion 103 configured to receive one or more searchlight components, including an assembly configured to rotate the housing, or another assembly configured to mount the housing to another device, consistent with that described in relation to FIGS. 3*a*, 3*b*, 4*a* and 4*b* below.

The pull-in bezel retention system 100 may also include other features that do not form part of the underlying invention disclosed and claimed herein, including features disclosed below in relation to FIGS. 1 to 1*d* and 3*a* to 4*b*.

Figure 3A:
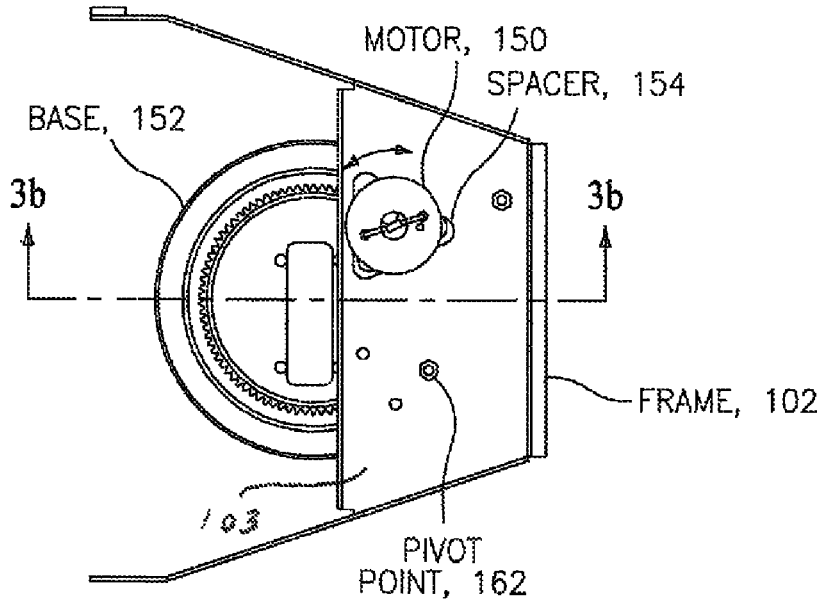
FIG. 3*a* shows a top-down view of a frame, a motor, and a base that form part of a searchlight assembly of a searchlight according to some embodiments of the present invention.
Figure 3B:
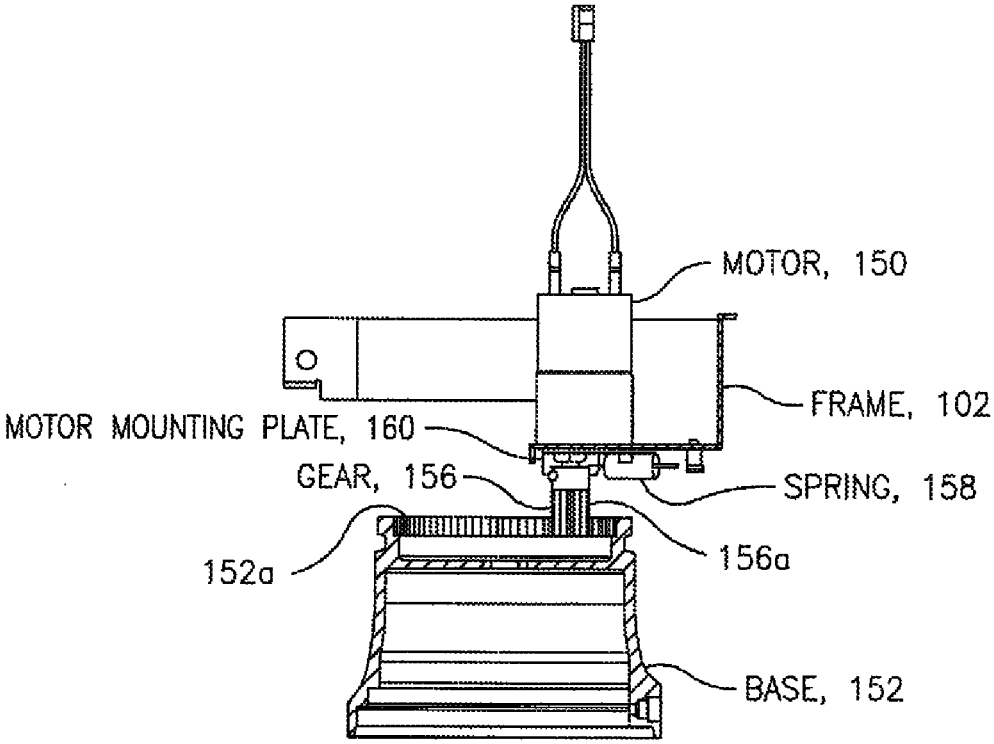
FIG. 3*b* shows a cross-sectional view along lines 3*b*-3*b* of that shown in FIG. 3*a* according to some embodiments of the present invention.

FIGS. 3*a*, 3*b*

Spring-Loaded Scan Motor

FIGS. 3*a* and 3*b* show an arrangement having a spring-loaded scan motor or gearmotor 150, a base 152, one or more spacers 154, a pinion gear 156, a spring 158 and a mounting plate 160 that forms part of the frame 102 according to some embodiments of the present invention. The base 150 has a stationary ring gear or teeth 150*a* that are coupled to the teeth 156*a* of the pinion gear 156 in order to rotate the frame 102 in relation to the base 150 when the spring-loaded scan motor 150 rotates the gear 156.

In operation, the spring 158 is coupled between a pivot point 162 of the frame 102 and the motor 150 and used to hold the gearmotor 150 with the pinion gear 156 against the stationary ring gear or teeth 156*a* for the purpose of actuating horizontal motion of the frame 102 in relation to the base 150.

The benefits of this solution include:

1. Enables the use of the pull-in bezel retention system 100 (FIGS. 2*a*-2*d*) described above by accommodating variability in positioning of the motor chassis; and thus variability in position of drive pinion relative the mating ring gear 152*a*.

2. Allows for economical fabrication of product by easing manufacturing tolerances on components and/or eliminating tedious adjustments during final assembly.

3. Minimizes "backlash" in the scan motion gear train; and maintains perfect engagement between the drive pinion 156 and the stationary ring gear 152*a*. It is well known that users are typically dissatisfied with any perceived looseness in the scan gear drive system.

FIG. 4*a*, 4*b*

Beam Sweep Mechanism

Figure 4A:
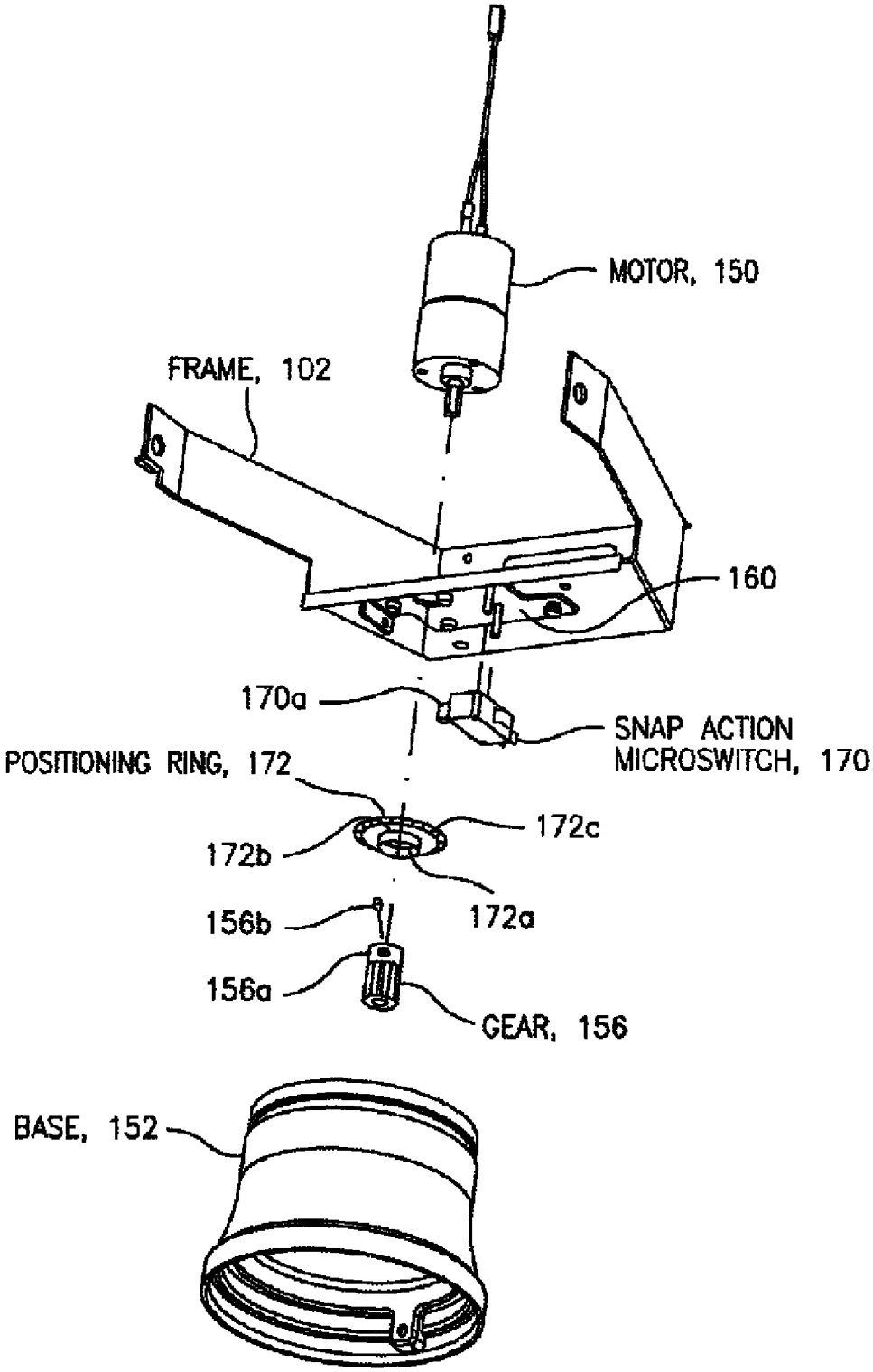
FIG. 4*a* shows an exploded view of a frame, a motor, a snap-action microswitch, a positioning ring, a gear and a base that form part of a searchlight assembly of a searchlight according to some embodiments of the present invention.
Figure 4B:
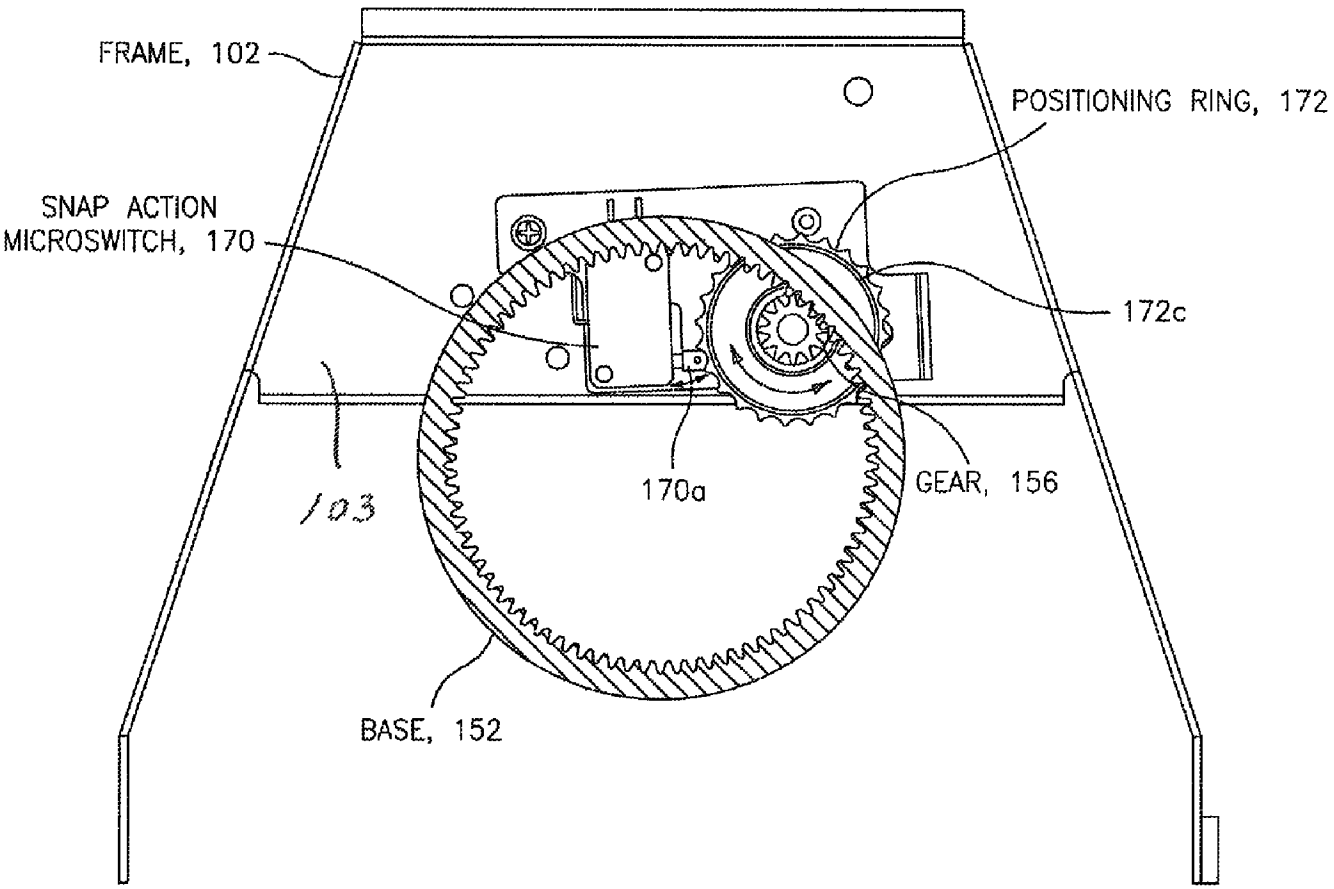
FIG. 4*b* shows a view of the frame, the motor, the snap-action microswitch, the positioning ring, the gear and the base shown in FIG. 4*a* as assembled according to some embodiments of the present invention.

FIGS. 4*a*, 4*b* show an arrangement for a beam sweep mechanism for a searchlight according to some embodiments of the present invention.

The beam sweep mechanism for marine searchlights involves sweeping the beam right and left of a center point to allow illumination of channel markers or hazards on each side of the craft. A common failure mode of this feature in the prior art searchlight(s) occurs when open-loop controllers allow the beam "drifts" off-center over time. Numerous closed-loop systems have been proposed to eliminate this problem, but are invariably expensive not robust enough for marine applications.

FIGS. 4*a* and 4*b* show the beam sweep mechanism that is a positioning mechanism for automated beam sweeping, which uses a robust counter arrangement to implement the beam sweep feature. For example, the counter arrangement may include a snap-action microswitch 170 in combination with a position ring 172. The position ring 172 has a collar 172*a* with a recess 172*b*. The gear 156 has a cylindrical surface 156*a* for receiving a fastener 156*b*. The snap sensor or snap-action microswitch 170 is coupled to the position ring 172 by sliding the collar 172*a* over the cylindrical surface 156*a*, and inserting the fastener 156*b* into the recess 172*b*. The positioning ring or toothed wheel 172 has circumferentially arranged teeth 172*c*.

In operation, the snapswitch sensor or snap-action microswitch 170 has a projecting member 170*a* that rides on the circumferentially arranged teeth 172*c* of the positioning wheel or toothed wheel 172 to send a contact-closure signal containing closed-loop position data back to a digital controller, which forms part of the snapswitch sensor or snap-action microswitch 170. Using an open-loop control, this arrangement or system can accurately track the position of the searchlight; allowing continued scanning while eliminating beam drift over time. No marine searchlights have been known to implement this rugged, simple, solution.

Snapswitch sensor or snap-action microswitches like 170 are known in the art and the scope of the invention is not intended to be limited to any particular type or kind thereof, either now known or later developed in the future.

Wireless Control for Improved Slip Ring Reliability

For high-end searchlights, users or customers have a preference for improved reliability of 360 degree motion. This is particularly important for workboats and search-an-rescue where beam spotting may be needed anywhere around the craft. All known solutions involve slip-rings (sliding contacts) to bring electrical power and control signals from the stationary assembly to the moving assembly in the searchlight. It has been shown that low-level signals such as motors and control signals exhibit poor reliability when brought across a slip ring.

Separately, wireless control is known for marine searchlights. It has been implemented in a number of models for the purpose of improving convenience and cost.

However, the new searchlight according to some embodiments of the present invention appears to be the first to implement 360 degree motion and radio frequency (RF) communication in tandem. RF communication is selected for the purpose of reducing the number of conductors that need sliding contacts to implement 360 degree motion. The new searchlight requires only two sliding contacts (Power + and −), with all other control signals communicated wirelessly.

8-Way Beam Pointing Using Wireless Control

Customers or users have shown a preference for 8-way control of beam pointing. With 8-way control, the searchlight can be pointed not only Right-Left and Up-Down, but simultaneously Left-Up, Right-Down, etc. Wired controllers that implement this feature are well known. The searchlight according to the present invention features 8-way pointing using a wireless controller.

SCOPE OF THE INVENTION

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

We claim:

1. A searchlight comprising:

a bezel pull-in retention assembly having a frame having a back plate configured with a fastening device; and a housing configured with a front end opening for receiving the frame, the housing also configured with a back end opening having an outer rim for receiving a seal plate, the seal plate configured to be adapted in the outer rim of the back end opening, the seal plate configured to receive the fastening device passing through the back end opening of the housing, and the seal plate and the fastening device being configured to fixedly couple the frame to the housing.

2. A searchlight according to claim 1, wherein the fastening device comprises a bolt or threaded stud and a nut or fastener for coupling the frame and the seal plate together.

3. A searchlight according to claim 2, wherein the bolt or threaded stud is passed through an opening in the back plate of the frame, through an opening in the seal plate, and the nut or fastener is tightened on the bolt or threaded stud to pull the frame into, and affix the frame to, the housing with the seal plate.

4. A searchlight according to claim 1, wherein the seal plate is configured with threads to receive corresponding threads of a bolt or threaded fastener that forms part of the fastening device; and the bolt or threaded fastener is passed through an opening in the back plate of the frame, and threaded onto the threads of the seal plate.

5. A searchlight according to claim 1, wherein the frame has a base plate or portion configured to receive one or more searchlight components, including an assembly configured to rotate the housing, or another assembly configured to mount the housing to another device.

6. A searchlight according to claim 1, wherein the frame is configured to retain a bezel that forms part of a light source.

7. A method comprising:

arranging a frame having a back plate configured with a fastening device in a housing configured with a front end opening for receiving the frame, the housing also configured with a back end opening having an outer rim for receiving a seal plate; and adapting the sealing plate in the outer rim of the back end opening of the housing so that the sealing plate receives the fastening device passing through the back end opening of the housing, and the sealing plate and the fastening device fixedly couple the frame and the housing together.

8. A method according to claim 7, wherein the method further comprises passing a bolt or threaded stud through an opening of the back plate of the frame and also through an opening in the seal plate, and tightening a nut or fastener onto the bolt or threaded stud to pull the frame into, and affix the frame to, the housing with the seal plate.

9. A method according to claim 7, wherein the method further comprises passing a bolt or threaded stud through the opening of the back plate of the frame and tightening threads of the bolt or threaded stud into corresponding threads of the seal plate to pull the frame into, and affix the frame to, the housing with the seal plate.

10. A method according to claim 7, wherein the method comprises configuring one or more searchlight components on a base plate or portion of the frame, including an assembly configured to rotate the housing, or another assembly configured to mount the housing to another device.

11. A method according to claim 7, wherein the method comprises coupling a bezel configured to receive a light source onto a portion of the frame that is configured to couple retain the bezel and frame together.

12. A searchlight according to claim 7, wherein the method comprises coupling the frame and the seal plate together using a fastening device that comprises a bolt or threaded stud and a nut or fastener.

* * * * *